US009289827B2

(12) United States Patent
Voice et al.

(10) Patent No.: US 9,289,827 B2
(45) Date of Patent: Mar. 22, 2016

(54) MOULD ASSEMBLY FOR A HOT ISOSTATIC PRESSING PROCESS

(75) Inventors: Wayne E. Voice, Nottingham (GB); Thomas P. Jarvis, Derby (GB)

(73) Assignee: ROLLS-ROYCE PLC, London (GB)

( * ) Notice: Subject to any disclaimer, the term of this patent is extended or adjusted under 35 U.S.C. 154(b) by 1176 days.

(21) Appl. No.: 13/253,585

(22) Filed: Oct. 5, 2011

(65) Prior Publication Data

US 2012/0100033 A1 Apr. 26, 2012

(30) Foreign Application Priority Data

Oct. 20, 2010 (GB) ..... 1017696.4

(51) Int. Cl.
*B22F 3/15* (2006.01)
*B22F 3/12* (2006.01)
*B22F 5/00* (2006.01)

(52) U.S. Cl.
CPC ..... *B22F 3/1216* (2013.01); *B22F 3/15* (2013.01); *B22F 2003/153* (2013.01); *B22F 2005/005* (2013.01); *B22F 2998/00* (2013.01)

(58) Field of Classification Search
CPC ..... B23F 3/1216
USPC ..... 419/49
See application file for complete search history.

(56) References Cited

U.S. PATENT DOCUMENTS

| | | | | |
|---|---|---|---|---|
| 4,575,327 | A * | 3/1986 | Borchert et al. | 425/78 |
| 7,540,470 | B1 * | 6/2009 | Blume | 251/333 |
| 2005/0142023 | A1 * | 6/2005 | Voice et al. | 419/38 |
| 2006/0266801 | A1 * | 11/2006 | Tonks et al. | 228/101 |
| 2008/0257457 | A1 * | 10/2008 | Cao et al. | 148/428 |
| 2012/0100032 | A1 * | 4/2012 | Voice et al. | 419/49 |

FOREIGN PATENT DOCUMENTS

JP A-01-252703 10/1989

OTHER PUBLICATIONS

Search Report issued in British Patent Application No. 1017696.4 dated Nov. 28, 2010.

* cited by examiner

*Primary Examiner* — Jessee Roe
*Assistant Examiner* — Christopher Kessler
(74) *Attorney, Agent, or Firm* — Oliff PLC

(57) ABSTRACT

This invention relates to a mould assembly for a hot isostatic pressing, HIP, process for fabricating a component, comprising: a first part which includes a shaped surface for forming a first surface of the component, the shaped surface having at least one recess; a second part arranged to move relative to the first part during the HIP process so as to compress a powder in-fill held therebetween, wherein the second part includes a formation configured to focus pressure toward the recess so as to aid consolidation of the powder in-fill at a distal end thereof.

17 Claims, 4 Drawing Sheets

MOULD ASSEMBLY FOR A HOT ISOSTATIC PRESSING PROCESS

BACKGROUND OF THE INVENTION

Figure 1:
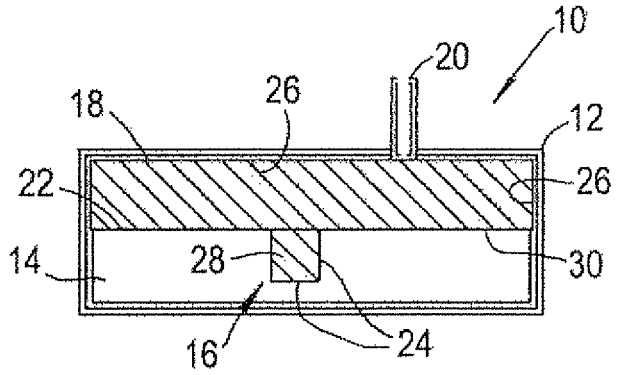

This invention relates to a mould assembly for manufacturing components using Hot Isostatic Pressing, HIP. In particular, this invention relates to a reusable mould for manufacturing components using HIP.

HIP fabrication involves the consolidation of a metal or ceramic powder under high temperature and high pressure conditions. Typically, net-shape HIP processes use a machined consumable mild steel canister as a mould in which a powder in-fill is consolidated into a required component shape. After the HIP process is complete, the consumable canister is removed from the formed component by machining and pickling.

The use of consumable canisters is inherently time consuming and materially expensive as each manufactured component requires a new canister. Further, the pickling process requires highly caustic chemicals which have cost and potential safety implications for the technology.

The applicants have investigated the use of re-usable moulds in which a substantially incompressible mould is housed within a plain canister. The canister in this instance is still consumable, however, because the features are formed within a re-usable mould, the canister is simpler to design and manufacture.

The use of a reusable mould addresses many of the drawbacks of consumable canisters of the prior art. However, using reusable moulds provides new difficulties.

SUMMARY OF THE INVENTION

The present invention seeks to overcome some of the problems the applicant has discovered with re-usable moulds for HIP processes.

In a first aspect the present invention provides a mould assembly for a hot isostatic pressing, HIP, process for fabricating a component, comprising: a first part which includes a shaped surface for forming a first surface of the component, the shaped surface having at least one recess; a second part arranged to move relative to the first part during the HIP process so as to compress a powder in-fill held therebetween, wherein the second part includes a formation configured to focus pressure toward a first end of the recess so as to aid consolidation of the powder in-fill at a second end of the recess.

The use of re-usable incompressible moulds for powder HIP processes has the undesirable effect of applying a substantially uniform pressure to the first surface of a component. This is problematic for protrusions on the first surface of the component which are formed in recesses in the shaped surface of a re-usable mould as the pressure applied to the increased volume of powder within the recess can be insufficient. This can lead to incomplete consolidation of the powder in-fill and an inferior component.

Having a mould assembly with a second part which includes a formation for focussing pressure toward the recess allows a greater degree of pressure within the recess. This allows for better compaction and consolidation of the powder in-fill.

By focussing pressure it is meant that the pressure applied to the recess via the formation is greater than the isostatic pressure applied to the exterior of the mould assembly.

The component may be for a gas turbine engine. The gas turbine engine may be an aero engine. The component may be one from a group consisting of fan and compressor casings.

The first part may be made from a substantially incompressible material which does not deform during the HIP process so as to be re-usable.

The recess in the shaped surface corresponds to a protrusion to be formed on the first surface of the component. The component protrusion may be one of the group which comprises ribs, flanges and bosses. The at least one recess may be round in cross section. For example, the at least one recess may be circular or oval. The at least one recess may be polygonal in cross section. The at least one recess may be regular or irregular in cross section. The recess may be elongate. The longitudinal axis of the recess may be perpendicular to the general plane of the first part.

The component may include multiple recesses. The formation on the second part may be configured to focus pressure towards a plurality of recesses. Alternatively, a plurality of formations may be configured to focus pressure towards one or more recesses.

The second part may be made from an incompressible material. The incompressible material may be the same as the first part. Although the present invention is principally aimed towards HIP processes which use re-usable moulds, it is to be understood that the invention is not limited to re-usable moulds.

The component material may be one of a group of materials consisting of titanium alloys. The titanium alloys may include aluminium and vanadium.

HIPing of titanium alloys requires a thermal soak in the order of 900 degrees centigrade with pressures in the order of 100 MPa to 140 MPa. Hence, it is necessary to use a mould material which can withstand this temperature and pressure without deforming or compressing. Hence, the first part may be made from a substantially incompressible material which does not deform during the HIP process so as to be re-usable. The first part material may be one of a group of materials consisting of high temperature capable nickel alloys.

The Nickel alloys may include chronite and turbine blade casting alloys.

A further advantage of the Nickel alloy should be that it does not bond to itself or a titanium component or a canister alloy during or after HIPing. Hence, the first and second parts of the mould assembly can be separated from the formed component without damage.

The formation may be convex or concave. The formation may be a protrusion. The protrusion may extend from a body of the second part toward the first part when the mould is assembled. The protrusion may be elongate. The longitudinal axis of the protrusion may be perpendicular to the general plane of the second part. The protrusion may be round in cross section. For example the cross section may be circular or oval. The protrusion may be polygonal in cross section. The cross section of the protrusion may regular or irregular. The protrusion may be cylindrical or cubiodal. The protrusion may have a constant cross sectional area along its length. The cross sectional area of the protrusion may increase along its length relative to the recess.

When assembled, the protrusion may have a cross sectional area at the proximal face which is greater than an open end of the recess. The cross sectional area of the proximal face may be the same as the open end of the recess. The cross sectional area at the proximal face may be smaller than the open end of the recess. The recess and protrusion may be concentrically aligned.

The proximal face of the protrusion may include features or formations to help focus the pressure towards the at least one recess. For example, the proximal face of the protrusion may be concave. Alternatively, the proximal face may include a formation or feature which distributes the pressure across a recess.

The mould assembly may include a sealed canister in which the first part and second part are housed for the HIP process. The second part may contact a canister so as to be subjected to the isostatic pressure during the HIP process. The contact may be direct. Alternatively, the contact may be via an intermediate member. The second part may include a pressure plate which contacts the canister so as to be subjected to the isostatic pressure during the HIP process. The pressure plate and formation may be integrally formed. The pressure plate may be round or polygonal. The pressure plate may be integral to the canister which houses the mould assembly and powder in-fill when in use. The formation may be an integral part of the canister.

The canister may have a lid so as to seal it. The lid may be attached to the canister via any suitable means such as welding. The canister may be a mild steel canister. The canister may have a wall thickness of less than 6 mm. Alternatively, the canister may have a wall thickness less than 5 mm. The canister may have a wall thickness of less than 4 mm. The canister may have a wall thickness greater than 1 mm. The canister may have a wall thickness greater than 2 mm. The canister may have a wall thickness greater than 3 mm. The canister may include an annex for housing parts of the mould assembly. The annex may be attached to the canister via a welding. The annex may be integral to the canister. The annex may form part of the lid of the canister.

The mould assembly may further comprise a seal which defines a void around at least a portion of the second part, the seal preventing ingress of powder in-fill into the void prior to the application of isostatic pressure in the HIP process.

The void may be provided so that the second part can move into the void toward the first part during the HIP process. The seal may be rigid. The seal may be a plate. The seal may be a flexible membrane. The flexible membrane may be a foil. The foil may be made from mild steel. The thickness of the foil may be in the range of between 50 microns to 1000 microns.

The formation may pass through the seal. The seal may envelope second part. The seal may envelope the pressure plate and the formation so as to separate the pressure plate and formation from the powder in-fill.

The formation may have a proximal face which is larger than the open end of the recess. The proximal face may be substantially the same size as the proximal face of the open end of the recess. The protrusion may be dimensioned so as to fit within the recess during the HIP process such that a cavity can be formed in the rear of the component protrusion.

The second part may be movable from a first pre-pressure position to a second post-pressure position, wherein when the second part is in the post-pressure position at least a portion of the protrusion sits within the recess such that a component protrusion formed within the recess includes a cavity in a rear side thereof.

The first part may comprise an insert having a plurality of pieces which combine to provide the recess and a holding piece having at least one cavity in which the insert is mateably received.

During a HIP process the mould and constituent powder in-fill expand and contract during the thermal cycle. If the thermal expansion of the mould is greater than that of the component material, any protrusions will be compressed and frictionally retained within the tooling when cooled. Subsequent separation often leads to damage of the tooling or component. This problem is greater for large component manufacture and for components which include multiple protrusions.

Having a holding piece with an insert which can be split into multiple pieces allows the tooling to be disassembled after the HIP process is complete. Hence, each piece of the mould can be pulled obliquely away from the surface of a manufactured component rather than being tangentially slid off a protrusion against any frictional retention.

The insert may comprise a facing surface against which a portion of the component is formed and wherein a portion of the parting line between the insert and holding piece has a draft angle in the range of between 10 and 60 degrees with respect to the a facing surface of the insert.

The holding piece may include a facing surface against which a portion of the component is formed in use.

The cavity which mateably receives the insert may be an aperture which passes through the holding piece from a first side which faces the component to an exterior second side such that a force can be applied to the insert from the exterior second side so as to remove it from the holding piece after use.

A portion of the parting line between the insert and holding piece may have a draft angle with regard to the facing surface of the insert in the range of between 10 and 60 degrees. Preferably, the draft angle is substantially 45 degrees. Having a parting line with a draft angle of 45 degrees allows the insert to be separated from the holding piece more readily.

The insert may include a parting line which dissects the insert into pieces. There may be two or more insert pieces. The insert pieces may be symmetrical. The insert pieces may be similar in size and shape. The insert pieces parting line may be flat so as to not be interlocking. The insert pieces parting line may extend perpendicularly from the facing surface of the insert.

The cavity which mateably receives the insert may be an aperture. The aperture may pass through the holding piece such that a force can be applied to the insert from an exterior surface of the mould assembly so as to remove the insert from the holding piece after use.

The insert may include a through-hole so as to expose the powder in-fill to the exterior of the mould assembly. The through-hole may comprise portions of the or each insert piece. Having a though-hole in the insert allows a pressure to be applied directly to the second end of the recess via the canister which can aid consolidation and provide shorter HIP process times.

The insert may include a recess having walls which extend at substantially 90 degrees from the facing surface of the insert. Alternatively, the walls may extend from the facing surface at an angle less than 90 degrees. The cross sectional area of the recess may increase along the length of a recess such that a formed protrusion can have an overhang with respect to the facing surface.

In a second aspect the present invention provides a method of fabricating a component using a mould assembly in a HIP process, the mould assembly including: a first part which includes a shaped surface for forming a first surface of the component, the shaped surface having at least one recess; a second part arranged to move relative to the first part during the HIP process so as to compress a powder in-fill held therebetween, wherein the second part includes a formation configured to focus pressure toward a first end of the recess so as to aid consolidation of the powder in-fill at a second end of the recess, wherein the method includes the steps of: enclosing the first part and second part within a canister so as to provide the assembled mould assembly in which the first and second part can be moved relative to each other during the HIP process; filling the canister with a powder in-fill which will form the component;

evacuating the canister; applying a thermal and pressure cycle to the canister so as to move the second part relative to the first part such that the powder in-fill is consolidated within the recess; removing the canister from the component and mould assembly;

removing the first part and second part from the component.

The method of the second aspect may include the step of providing a seal which defines a void around at least a portion of the second part. The seal may prevent ingress of powder in-fill into the void prior to the application of isostatic pressure in the HIP process.

The mould assembly used in the method of the second aspect may further comprise an insert comprising a plurality of pieces which combine to provide the recess in which a protrusion of the component can be formed and a holding piece having at least one formation in which the insert is mateably received. In this case, the method may further include the steps of: mateably inserting the pieces of the insert into the holding piece formation to provide the first part; and, removing the holding piece from the component and insert pieces and, individually removing the insert pieces so as to remove the first part after the canister has been removed from the component and mould assembly.

The cavity which mateably receives the insert may be an aperture which passes through the holding piece, and the method of the second aspect may comprise the further step of: applying a force to the insert from the exterior of the mould assembly so as to separate the holding piece and insert.

BRIEF DECRIPTION OF THE DRAWINGS

Embodiments of the present invention will now be described with the aid of the following drawings in which:

FIG. 1 shows a cross section of a mould assembly for a HIP process.

Figure 2A:
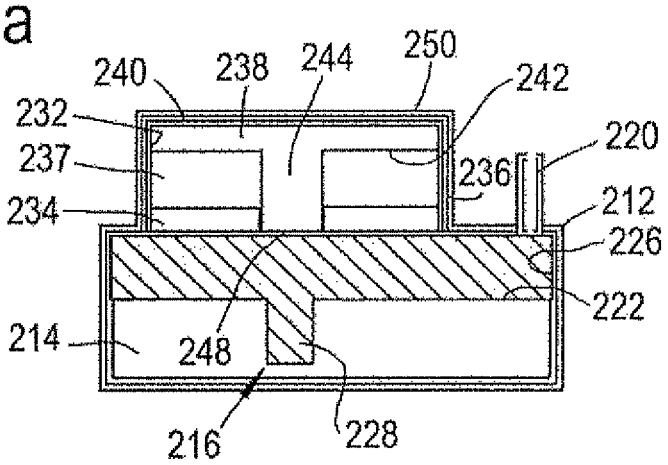
Figure 2B:
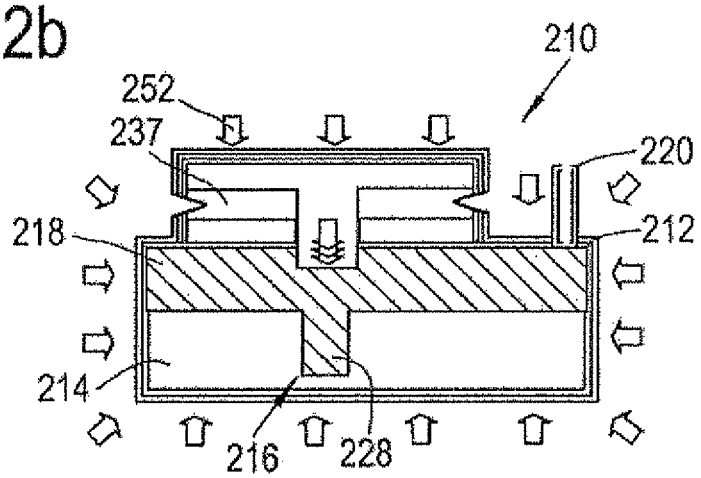

FIGS. 2*a* and 2*b* show a cross section of a mould assembly according to the present invention before and during a HIP process, respectively.

Figure 3:
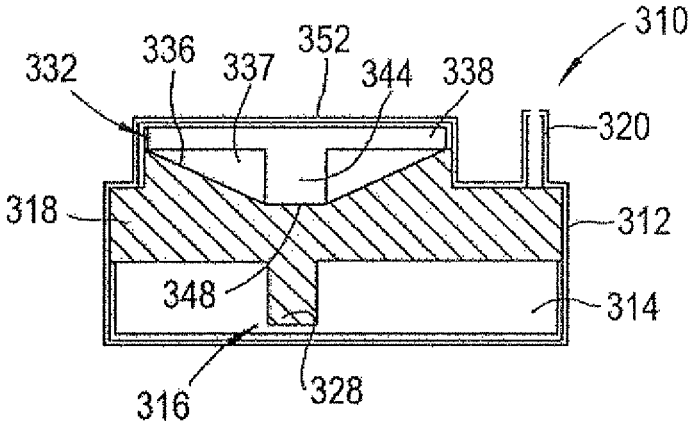

FIG. 3 shows an alternative embodiment of the mould assembly according to the present invention.

Figure 4A:
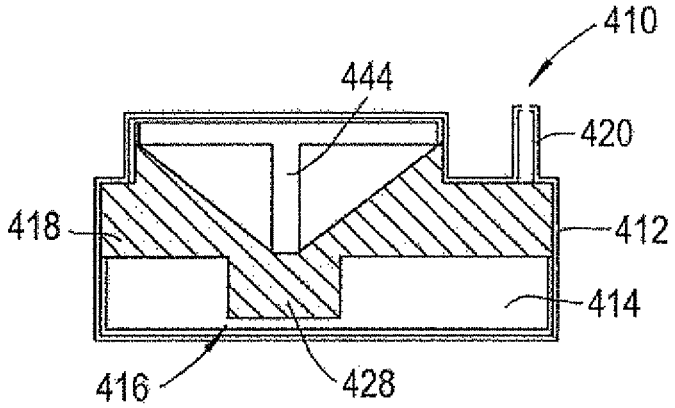
Figure 4B:
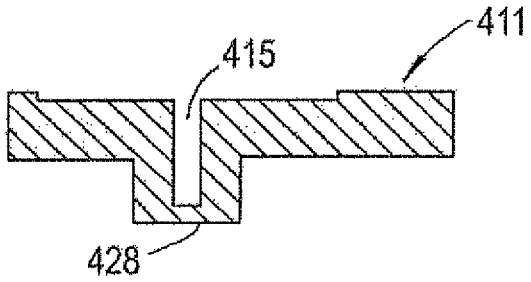

FIGS. 4*a* and 4*b* show cross sections of another embodiment of the present invention and the resulting component, respectively.

Figure 5A:
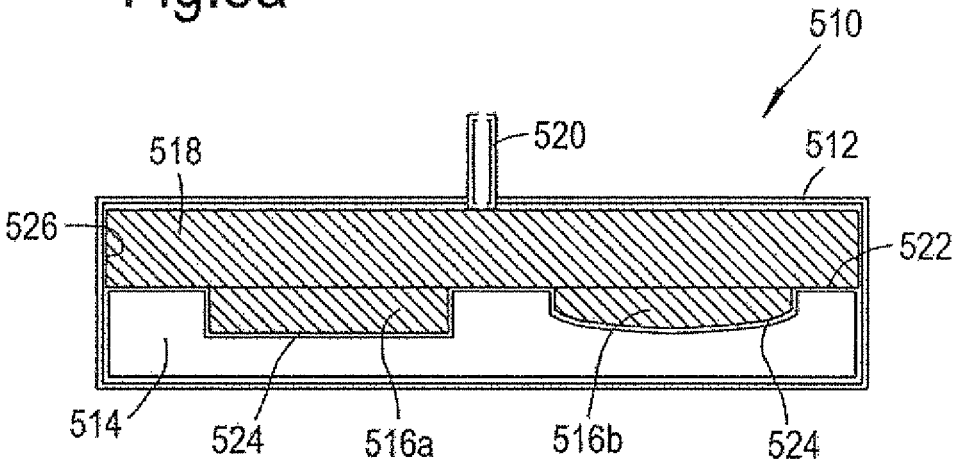
Figure 5B:
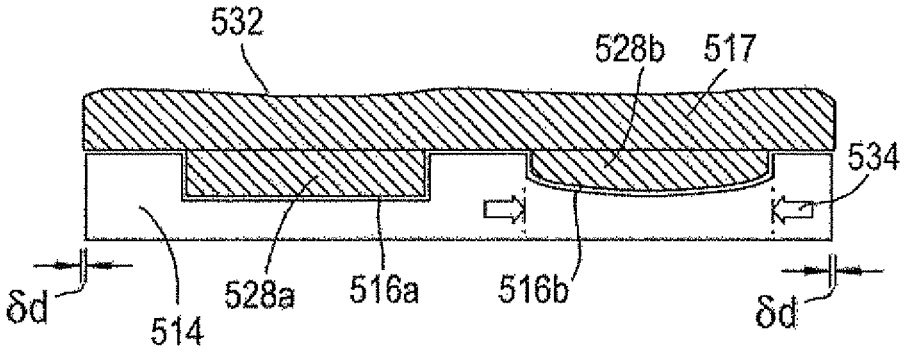

FIGS. 5*a* and 5*b* show a reusable HIP mould assembly in cross-section before and after HIPing respectively.

Figure 6A:
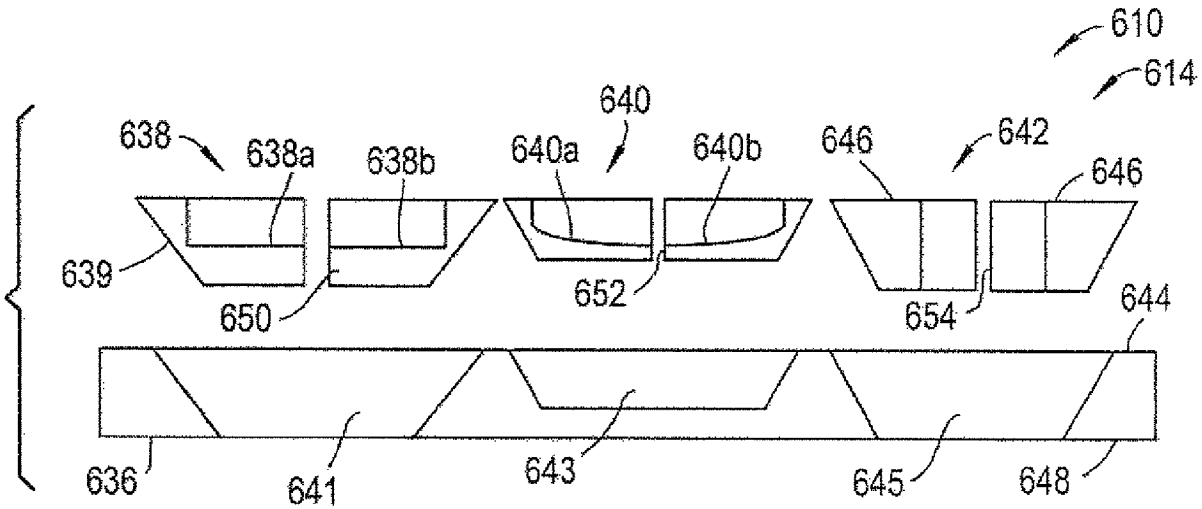
Figure 6B:
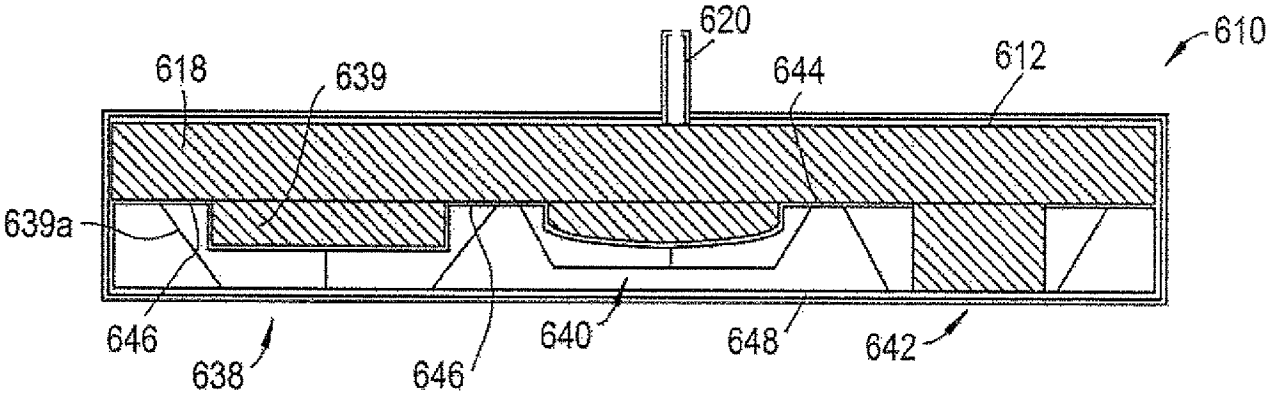

FIGS. 6*a* and 6*b* show embodiments of the first part of a reusable HIP mould in cross section.

DETAILED DESCRIPTION OF THE INVENTION

Throughout the following description reference is made to proximal and distal ends, surfaces and sides of various parts. Generally, the terms proximal and distal are in relation to the powder in-fill such that proximal relates to the end, side or face closest to or within the powder in-fill and distal relates to the end, side or face furthest from the powder in-fill.

FIG. 1 shows a HIP mould assembly 10 comprising a canister 12 in the form of a mild steel box, a reusable mould 14 having a recess 16 and a powder in-fill 18. The powder in-fill 18 is introduced to the canister 12 via a filling tube 20 and fills the void defined between the upper 22 and cavity 24 surfaces of the reusable mould 14 and the walls 26 of the canister 12.

The powder in-fill is consolidated during a HIP process so as to form a component and includes the constituent materials which make up the component. In the present embodiment the formed component is a titanium alloy which is a particularly useful material for gas turbine engine components due to the low density and low high temperature creep. The titanium alloy is Ti6/4. Suitable particle sizes for HIPing with titanium alloys typically range from 50 to 250 microns. Of course the skilled person will appreciate that other materials can readily be used in HIP manufacturing as is known in the art.

The mould 14 is a substantially incompressible block of nickel alloy, for example, a high temperature turbine blade casting alloy, having a shaped surface which has been machined to provide the shape of the component which is desired. The shaped surface includes a first surface 22 and a recess 16 which corresponds to a protruding feature 28 on the first surface of the component in the form of a boss. The boss extends perpendicularly from the first surface 30 of the component and has a planar distal face. The skilled man will appreciate that the geometry of the mould needs to be calculated to allow for the thermal expansion of the mould at the HIP temperature and the contraction of the cooled component.

The canister 12 is a mild steel vessel in which the mould can be placed prior to being sealed shut, typically by having a lid welded in place. The canister 12 needs to be of a suitable thickness so as to maintain the sealed environment for the mould 14 and powder in-fill 18 during the HIP process. This thickness will vary according to the material and dimension of the component being produced but is typically in the order of a few millimetres.

To form a component from titanium alloys, it is necessary to use a high temperature soak, typically in the range of 900 degrees. Hence, the reusable mould 14 needs to be of a suitable material to withstand the necessary high temperature. Nickel alloys are generally suitable for making reusable moulds for the HIP process. Further, nickel alloy components tend not to bond to the titanium alloy component which helps with the separation of the mould 14 and component after the HIP process is complete.

To form a component, the mould 14 is loaded into the canister 12 which is then sealed. The powder in-fill 18 is injected into the canister 12 via tube 20 so as to fill the void which is defined by the walls 26 of the canister 12 and the facing surface of the mould 14. Any air which remains in the canister 12 is evacuated from the void using a vacuum pump. A typical evacuation pressure is 1.3 Pa. The canister is placed within a pressure vessel which is evacuated and filled with an inert gas such as Argon. The canister is then subjected to a temperature soak of approximately 920 degrees under an external isostatic pressure of approximately 120 MPa to 140 MPa for between 2 and 4 hours, before being cooled and removed from the pressure vessel.

Once cooled, the canister is removed via a combination of machining and pickling before the component taken from the mould and machined to provide the finished article.

Because the re-usable mould is incompressible the pressure applied to the first surface of the component is uniformly distributed across the width of the mould as viewed in FIG. 1. Hence, there can be insufficient pressure to consolidate the volume of powder in-fill within the recess. Hence, in particularly there can be a lack of consolidation at the distal end of deep recesses which can lead to an inferior component being produced.

FIG. 2*a* shows a mould assembly 210 according to the present invention. In addition to the assembly shown in FIG. 1, the mould assembly 210 includes a first part 214, a second part 232, a guide member 234 and a seal 236 in the form of a mild steel foil wrap. The second part 232, guide member 234 and seal 236 are all housed within an annex 250 of the canister 212.

The first part 214 has a shaped surface 222 which has been machined to include a recess 216 of the appropriate dimensions for creating a component with a boss 228. The skilled person will appreciate that the exact dimensions required of the recess 216 will in part be determined by the thermal expansion and shrinkage of the first part 214 and the component during and after the HIP process.

The second part 232 includes a pressure plate 238 in the form of a Nickel alloy disc. The pressure plate 238 has a distal surface 240 which is in contact with the canister 212 via the foil seal 236 such that the pressure on the outside of the canister 212 results in a force to the pressure plate 238. On the proximal side 242 of the pressure plate 238 there is an integral formation in the form of a protrusion 244. The protrusion 244 is an elongate cylindrical member which extends perpendicularly in relation to its longitudinal axis from the centre of the proximal side 242 of the pressure plate 238 toward the recess 216 in the first part 214 of the mould assembly 210.

The force placed on the pressure plate 238 via the isostatic pressure is transferred to the proximal face 248 of the protrusion. The surface of the pressure plate 238 in contact with the canister 212 is substantially larger than the proximal face 248 of the protrusion 244 such that the pressure exerted by the protrusion 244 on the powder in-fill 218 in the vicinity of the proximal face 248 is greater than the isostatic pressure on the pressure plate 238. In this way, the isostatic pressure is focussed towards the recess 216.

The pressure plate 238 and protrusion 244 rest in a first position prior to the application of the isostatic pressure. When isostatic pressure is applied to the exterior of the canister 212, the pressure plate 238 and protrusion 244 are forced toward the recess 216 in the first part 214 of the mould assembly 210 until coming to rest at a second position once the compaction and consolidation process of the powder in-fill 218 is complete.

The mould assembly 210 includes a guide member 234. The guide member 234 is a plate of a similar size and shape to the pressure plate 238 with a central aperture which snugly receives and supports the protrusion 244 as it passes from the first position to the second position.

Prior to the HIP process the pressure plate 238, protrusion 244 and guide member 234 are set within an annex 250 of the canister 212. The annex 250 is sealed from the main canister chamber by a seal 236 in the form of a mild steel foil having a thickness of approximately 200 micrometres. The foil seal 236 envelopes the pressure plate 238, protrusion 244 and guide member 234 so as to prevent ingress of the powder in-fill 218 prior to the HIP process and thereby provides a void 237 between the pressure plate 238 and guide 234 into which the pressure pate can move under isostatic pressure. The dimensions of the canister annex 250 walls are such that they are forced inward so as to collapse during the movement of the pressure plate 238 from the first position towards the second position, as shown in FIG. 2*b*.

To form a component, the mould is loaded into the canister 212 which is then sealed. The powder in-fill 218 is injected into the canister 212 via tube 220 so as to fill the void which is defined by the walls 226 of the canister 212 and the shaped surface 222 of the first part 214 of the mould assembly. Any air which remains in the canister 212 is evacuated using a vacuum pump. A typical evacuation pressure is 1.3 Pa. The canister 212 is placed within a pressure vessel which is evacuated before being filled with an inert gas such as Argon. The canister 212 is then subjected to a temperature soak of approximately 900 degrees under an external isostatic pressure 252 of approximately 120 MPa to 140 MPa for between 2 and 4 hours before being cooled and removed from the pressure vessel.

The isostatic pressure 252 creates a force on the pressure plate 238 which causes it to move from the first position toward the second position and recess 216. The relationship between the pressure plate 238 and protrusion 214 is such that force applied to the larger area of the pressure plate 238 via the canister 212 wall is transferred to the smaller area of the proximal face 248 of the protrusion 244. This results generally in a redistribution of the isostatic pressure 252 on the exterior of the canister 212 to a focussed area of pressure beneath the proximal face 248 of the protrusion 244. As the proximal face 248 of the protrusion 244 moves toward the recess 216, the powder in-fill 218 at its distal end is compacted into and consolidates within the recess 216. This ensures that the consolidation within the recess is sufficient to provide a homogeneous protrusion on the first surface of the component.

The redistribution of pressure from the canister 212 to the proximal face 248 of the protrusion 244 largely deprives the area under the guide member 234 of a compacting pressure. However, once the pressure plate 238 contacts the guide member 234 it forces the guide member 234 toward the first part 214 of the mould assembly 210 so as to compact and consolidate the powder underneath the guide member 234. As this occurs, the isostatic pressure 252 on the pressure plate 238 is no longer focussed toward the recess 216 via the protrusion 244 but is spread uniformly across the proximal face of the guide member 234 and protrusion 244.

FIG. 3 shows mould assembly 310 similar to the assembly shown in FIG. 2*a* and *b*. Thus there is a canister 312 having a fill tube 320 and annex 350, a first part 314, second part 332 and seal 336. The second part 332 includes a pressure plate 338 and a protrusion 344 as per the previous embodiment. However, in this embodiment the guide member is omitted such that the travel of the protrusion 344 from the first position to the second position is guided by the isostatic pressure on the canister 312 and canister annex 352 walls and the contact with the powder in-fill 318.

The seal 336 is in the form of a mild steel foil which is similar to the embodiment in FIGS. 2*a* and 2*b*. The foil is wrapped around the pressure plate 338 and protrusion 344 so as to prevent ingress of the powder in-fill 318 into the space beneath the pressure plate 338 and provide a void 337 into which the pressure plate 338 can move under the isostatic pressure.

Once the isostatic pressure is applied during the HIP process the pressure plate 338 moves from the first position into the void 337 provided by the foil seal 336. As the pressure plate 338 moves the powder in-fill 318 lying adjacent the pressure plate 338 to flow and re-distribute under the compacting force, thereby spreading out to fill the void 337. Whilst this process is on going the force applied via the canister annex 312 wall on the distal face of the pressure plate 338 is largely focussed beneath the proximal face of the protrusion 348. Once, the powder has redistributed to substantially fill the void 337, the pressure plate 338 contacts and compacts the powder beneath it such that consolidation can take place. It will be understood that the foil seal 336 is of sufficient thickness and strength that it deforms and ruptures under the force of the pressure plate 338 such that the powder in-fill 318 can spread.

FIG. 4*a* shows an assembly similar to the assembly shown in FIG. 3. Thus, there is shown a mould assembly 410 including a first part 414 having a recess 416 in which a protrusion 438 of a component 411 can be formed. The mould assembly 410 also includes a second part 432 having a pressure plate 438 and a protrusion 444 which are separated from the powder in-fill 418 by a void 437 provided by a foil seal 436.

The dimensions of the protrusion 444 in the mould assembly 410 of FIG. 4*a* are such that it can fit within the recess 416 of the first part 414 when in the second position. In this way a hollow 415 is formed in the rear of the protrusion 428 as shown in FIG. 4*b*.

The following embodiments shown in FIGS. 5*a* and 5*b* describe a first part 514 of a mould assembly 510 which can be used with the mould assemblies 10, 210, 310, 410, of the previously described embodiments. The second part of the mould assembly is not shown in the following embodiments for the sake of clarity.

As with the earlier described embodiments, FIG. 5*a* shows a HIP mould assembly 510 which includes a canister 512 in the form of a mild steel box, a first part of a reusable mould 514 having a plurality of recesses 516*a*, 516*b* and a powder in-fill 518, which forms a component 517 once consolidated during the HIPing process. The powder in-fill 516 is introduced to the canister 512 via a filling tube 520 and fills the void defined between the upper 522 and recess 524 surfaces of the reusable mould 514 and the walls 526 of the canister 512. During the HIP process, the temperature soak and pressure consolidate the powder in-fill 518 so as to form a homogenous component 517.

FIG. 5*b* shows the component 517 and first part 514 after the HIP process with the canister 512 removed for clarity. The upper surface 532 of the component 517 as viewed in FIG. 5*b* is deformed as a result of the isostatic pressure applied during the HIP process. This deformation is typically removed in a subsequent machining step to provide the finished component.

The powder in-fill 518 and first part 514 expand during the thermal soak and contract during the subsequent cooling. The first part 514 and powder in-fill 518 (component 517) are made from a nickel alloy and a titanium alloy respectively. Hence, they have different coefficients of thermal expansion. Specifically, the nickel alloy of the mould 514 has a higher coefficient of thermal expansion and therefore contracts to a greater degree than the component 517 during the cooling phase of the HIP process. After cooling the component protrusions 528*a*, 528*b*, are larger than the mould by an amount two times delta d, as shown in FIG. 5*b*.

Because the protrusions 528 530 are entirely surrounded by the recesses 516*a*, 516*b*, a compressive force results which grips and retains the protrusions 528*a*, 528*b* within the respective recesses 516*a*, 516*b*, as shown in FIG. 5*b* by arrows 534. This prevents the mould being readily separated from the component and applying a large force to separate the two can result in damage to the mould 514 and or component 517.

The present invention provides a mould assembly 610 as shown in FIGS. 6*a* and 6*b*. The mould assembly 610 generally includes a holding piece 636 and inserts 638, 640, 642, which form the recesses in the mould assembly 610, The inserts 638, 640, 642, include a plurality of insert pieces 638*a,b*, 640*a,b*, 642*a,b*, which are retained in corresponding cavities in the holding piece 636 and which combine to form the recess required for a component protrusion.

All of the inserts 638, 640, 642 are generally a truncated cone shape with the larger end of the cone providing the facing surface 646 for abutting the powder in-fill 618 and the narrow end seated within the holding piece 636. When the inserts 638, 640, 642 are located in the holding piece 636, the facing surfaces 646 of the inserts and the facing surface 644 of the holding piece 636 are flush so as to provide a continuous smooth profile against which the component can be formed.

The first insert 638 on the left of the mould assembly 610 as viewed in FIGS. 6*a* and *b*, has a recess 639 within the conical body in the form of a cylinder having a circumferential side wall and flat circular base surface. The open end of the recess is defined as the first end and the base of the recess is defined as the second end. The insert is mateably received within a cavity 641 in the holding piece in the form of an aperture which passes from the facing surface 644 of the holding piece 636 to a second surface 648 on the exterior of the holding piece 636. The holding piece 636 and insert 638 mate so as to define a parting line 639*a* along the angled conical face 639 of the insert 638. The parting line 639*a* of the embodiment is at 45 degrees relative to the facing surface 646 of the insert 638. Having a parting line 639*a* of 45 degrees between the holding piece 636 and insert 638 allows the two parts to be easily separated after the HIP process is complete.

When the insert 638 is mateably received within the aperture 641 in the holding piece 636, as shown in FIG. 6*b*, the rear of the insert 638 is exposed from the wxterior surface 648 of the holding piece 636. This allows pressure to be applied directly to the rear surface of the insert 638 from the exterior of the mould assembly 610 once the canister has been removed which aids separation of the holding piece 636 and insert 638.

The second insert 640 is similar to the first insert 638 except that it has a curved circular base so as to provide the corresponding component protrusion with a domed distal end and that it is mateably received within a closed cavity 643. The closed cavity 643 forms a parting line with the insert which is parallel to the facing surface 646 of the insert 640. Hence, when the second insert 640 is placed within the closed cavity 643 the holding piece 636 envelopes the rear of insert 640.

The third insert 642 includes a through-hole rather than a closed recess. The through-hole allows the powder in-fill 618 to be exposed from a rear side of the insert 642 such that when it is inserted into the canister 612, pressure is more effectively applied to the second end of the recess which is in direct contact with the canister 612. The third insert 642 is situated within a cavity in the form of an aperture 645 in a similar way to the first insert 638.

Each of the inserts 638, 640, 642 include two insert pieces which are symmetrical about a central parting line 650, 652, 654, which dissects each insert 638, 640, 642. The parting lines 650, 652, 654, between pieces are flat and extend perpendicularly from the facing surface 646 of each insert so as to provide no interlock therebetween. In this way, the inserts 638, 640, 642, are held together at the parting lines 650, 652, 654, by the holding piece 636 and powder in-fill 618 only.

Having multiple pieces within a given insert 638, 640, 642, allows the insert to be disassembled from the component protrusion after a component has been formed during the HIP process. Specifically, the arrangement of the insert pieces 638, 640, 642, is such that each piece can be removed from the facing surface of the component at an oblique (or perpendicular) angle rather than parallel to and against any frictional retaining force. Hence, the frictional retaining force which results from the differential thermal contraction between the component and the first part 614 of the mould can be negated.

The inserts 638, 640, 642, and holding piece 636 are made from the same material, Nickel alloy, so as to provide the first part 614 with a uniform thermal expansion and contraction.

To form a component, the first part 614 is loaded into the canister 612 which is then sealed. The powder in-fill 618 is injected into the canister 612 via tube 620 so as to fill the void which is defined by the walls 626 of the canister 612 and the facing surface of the first part 614. Any air which remains in the canister 612 is evacuated from the void using a vacuum pump. A typical evacuation pressure is 1.3 Pa. The canister 612 is placed within a pressure vessel which is also evacuated before being filled with and inert gas such as Argon. The canister is then subjected to a temperature soak of approximately 900 degrees under an external pressure of approximately 120 MPa to 140 MPa for between 2 and 4 hours before being cooled and removed from the pressure vessel. Once the HIP process is complete the canister 612 can be removed by machining and pickling.

After the canister 612 is removed, the holding piece 636 can be removed from the component and inserts 638, 640, 642, simply by applying a pulling force to the holding piece 636, and an opposing pushing force to the exterior of the inserts 638, 642, which pass through the holding piece 636 to the exterior side. Once the holding piece 636 is removed, the inserts 638, 640, 642 are free to separate, the individual insert pieces are removed from the formed protrusions.

The skilled person will appreciate that the above described embodiments are demonstrative, not restrictive, and that the scope of the invention is determined by the claims. For example, the invention is primarily described in the context of a re-usable mould. However, the invention could be implemented on a disposable mould.

Further, the component and mould materials are not restricted to Titanium alloys and Nickel alloys respectively. Also, although the present invention is described in the context of large components for gas turbine engines, it will be understood that the invention is a generic one which may find application elsewhere.

The invention claimed is:

1. A mould assembly for a hot isostatic pressing, HIP, process for fabricating a component, comprising:

a first part which includes a shaped surface for forming a first external surface of the component, the shaped surface having at least one recess formed within the shaped surface;

a second part arranged to move relative to the first part during the HIP process so as to compress a powder in-fill held therebetween and form a second external surface of the component, wherein the first part is made from a substantially incompressible material which does not deform during the HIP process so as to be re-usable, and wherein the second part includes a formation corresponding to at least one recess in the first part, the formation being configured to focus pressure toward a first end of the recess so as to aid consolidation of the powder in-fill at a second end of the recess.

2. A mould assembly as claimed in claim 1, wherein the substantially incompressible material is a Nickel alloy.

3. A mould assembly as claimed in claim 1, wherein the formation of the second part is a protrusion.

4. A mould assembly as claimed in claim 3 wherein a protrusion of the second part is dimensioned so as to fit within the at least one recess of the first part during the HIP process so as to provide a cavity in a component protrusion formed within the at least one recess of the first part.

5. A mould assembly as claimed in claim 1 further comprising a canister in which the first part and second part are housed for the HIP process and wherein the second part includes a pressure plate in contact with the canister so as to be subjected to the isostatic pressure during use.

6. A mould assembly as claimed in claim 1 further comprising a seal which defines a void around at least a portion of the second part, the seal preventing ingress of powder in-fill into the void prior to the application of isostatic pressure in the HIP process.

7. A mould assembly as claimed in claim 6 wherein the seal is a flexible membrane or a foil.

8. A mould assembly as claimed in claim 7 wherein the thickness of the foil is in the range of between 50 microns to 1000 microns.

9. A mould assembly as claimed in claim 6 wherein the seal is a rigid member or plate.

10. A mould assembly as claimed in claim 1 wherein the first part comprises:

an insert having a plurality of pieces which combine to provide the at least one recess and a holding piece having at least one cavity in which the insert is mateably received.

11. A mould assembly as claimed in claim 10 wherein the insert comprises a facing surface against which a portion of the component is formed, and wherein a portion of a parting line between the insert and the holding piece has a draft angle in the range of between 10 to 60 degrees with respect to the facing surface of the insert.

12. A mould assembly as claimed in claim 10 wherein the holding piece includes a facing surface against which a portion of the component is formed in use.

13. A mould assembly as claimed in claim 10 wherein the cavity which mateably receives the insert is an aperture which passes through the holding piece such that a force can be applied to the insert from an exterior surface of the mould assembly so as to remove the insert from the holding piece after use.

14. A mould assembly as claimed in claim 10 wherein the recess includes a through-hole.

15. A mould assembly for a hot isostatic pressing, HIP, process for fabricating a component, comprising:

a first part which includes a shaped surface for forming a first surface of the component, the shaped surface having at least one recess;

a second part arranged to move relative to the first part during the HIP process so as to compress a powder in-fill held therebetween, wherein the second part includes a formation configured to focus pressure toward a first end of the recess so as to aid consolidation of the powder in-fill at a second end of the recess; and a seal which defines a void around at least a portion of the second part, the seal preventing ingress of powder in-fill into the void prior to the application of isostatic pressure in the HIP process, wherein the seal comprises foil.

16. A mould assembly for a hot isostatic pressing, HIP, process for fabricating a component, comprising:

a first part which includes a shaped surface for forming a first external surface of the component, the shaped surface having at least one recess formed within the shaped surface;

a second part arranged to move relative to the first part during the HIP process so as to compress a powder in-fill held therebetween and form a second external surface of the component, wherein the first part comprises an insert having a plurality of pieces which combine to provide the at least one recess and a holding piece having at least one cavity in which the insert is mateably received, and wherein the second part includes a formation corresponding to at least one recess in the first part, the formation being configured to focus pressure toward a first end of the recess so as to aid consolidation of the powder in-fill at a second end of the recess.

17. A mould assembly for a hot isostatic pressing, HIP, process for fabricating a component, comprising:

a first part which includes a shaped surface for forming a first external surface of the component, the shaped surface having at least one recess formed within the shaped surface;

a second part arranged to move relative to the first part during the HIP process so as to compress a powder in-fill held therebetween and form a second external surface of the component; and a seal which defines a void around at least a portion of the second part, the seal preventing ingress of powder in-fill into the void prior to the application of isostatic pressure in the HIP process, wherein the second part includes a formation corresponding to at least one recess in the first part, the formation being configured to focus pressure toward a first end of the recess so as to aid consolidation of the powder in-fill at a second end of the recess, and wherein the seal is a flexible membrane or a foil, or a rigid member or plate.

* * * * *